US008657126B1

(12) United States Patent
Loftin et al.

(10) Patent No.: US 8,657,126 B1
(45) Date of Patent: Feb. 25, 2014

(54) PRODUCT DISPENSING SYSTEM WITH DISPENSER DOOR

(71) Applicant: MeadWestvaco Corporation, Richmond, VA (US)

(72) Inventors: Caleb Loftin, Richmond, VA (US); Getachew Kassa, West Orange, NJ (US)

(73) Assignee: MeadWestvaco Corporation, Richmond, VA (US)

( * ) Notice: Subject to any disclaimer, the term of this patent is extended or adjusted under 35 U.S.C. 154(b) by 0 days.

(21) Appl. No.: 13/655,585

(22) Filed: Oct. 19, 2012

Related U.S. Application Data

(63) Continuation-in-part of application No. 13/595,316, filed on Aug. 27, 2012.

(51) Int. Cl.
*A47F 1/04* (2006.01)
*A47F 7/00* (2006.01)

(52) U.S. Cl.
USPC ..... 211/59.2

(58) Field of Classification Search
USPC ..... 211/14, 15, 59.2, 59.3, 59.4, 74, 76, 211/85.5, 126.1, 126.2, 126.3, 133.6, 194; 312/35, 42, 45, 61, 71; 108/60, 61
See application file for complete search history.

(56) References Cited

U.S. PATENT DOCUMENTS

| | | | |
|---|---|---|---|
| 902,347 | A | 10/1908 | Tillinghast |
| 1,291,420 | A | 1/1919 | Cough |
| 1,383,318 | A | 7/1921 | McCormick |
| 1,393,964 | A | 10/1921 | Potts et al. |
| 1,753,957 | A | 4/1930 | Washburn |
| 1,824,937 | A | 9/1931 | Trouth |
| 1,858,199 | A | 10/1932 | Maziroff |
| 1,898,056 | A | 2/1933 | Johnson |
| 1,919,907 | A | 7/1933 | Robinson |
| 1,932,225 | A | 10/1933 | Minter |
| 1,941,458 | A | 2/1934 | Bens |
| 1,985,739 | A | 12/1934 | Murray |
| 2,078,599 | A | 4/1937 | McCauley |
| 2,110,194 | A | 3/1938 | Blier |
| 2,263,353 | A | 11/1941 | Eidam |
| 2,291,187 | A | 7/1942 | Johnson |
| 2,382,191 | A | 7/1944 | Weichselbaum |
| 2,536,421 | A | 2/1951 | Burhans |
| 2,573,381 | A | 10/1951 | Arnold |
| 2,574,087 | A | 11/1951 | Burhans |
| 2,595,122 | A | 4/1952 | Burhans |
| 2,784,871 | A | 3/1957 | Gabrielsen |
| 2,795,845 | A | 6/1957 | Shimer |

(Continued)

FOREIGN PATENT DOCUMENTS

| | | |
|---|---|---|
| AT | 6036 U1 | 3/2003 |
| DE | 2655496 | 6/1978 |

(Continued)

*Primary Examiner* — Joshua Rodden
(74) *Attorney, Agent, or Firm* — MeadWestvaco Intellectual Property Group

(57) ABSTRACT

A plurality of product dispensing frames, each having a left side wall, a right side wall, a front end, and a rear end, and including an upper support deck extending between the front end and the rear end, a lower support deck positioned below the upper support deck, the lower support deck extending between the front end and the rear end and defining a product display area, and a dispenser door pivotably connected between outermost dispenser frames to cover and enclose the upper support decks.

17 Claims, 11 Drawing Sheets

(56) References Cited

U.S. PATENT DOCUMENTS 2,818,978 A 1/1958 Post
2,826,471 A 3/1958 Fonda
2,831,591 A 4/1958 Morton
2,888,145 A 5/1959 Knott et al.
2,915,932 A 12/1959 Gross
2,919,488 A 1/1960 Brownlee
2,996,344 A 8/1961 Garman
3,018,149 A 1/1962 Parker
3,055,293 A 9/1962 Lariccia
3,066,827 A 12/1962 Pryor
3,137,068 A 6/1964 Quigley
D198,888 S 8/1964 Heselov
3,178,242 A 4/1965 Ellis et al.
3,184,104 A 5/1965 De Domenico et al.
3,203,554 A 8/1965 Pendergrast et al.
3,204,335 A 9/1965 Hughes
3,288,544 A 11/1966 Knecht
3,300,115 A 1/1967 Schauer
3,304,141 A 2/1967 Rogers
3,306,688 A 2/1967 Di Domenico
3,318,455 A 5/1967 Takahashi
3,335,940 A 8/1967 Dykes
3,340,790 A 9/1967 Simjian
3,348,738 A 10/1967 Hertlein
3,392,901 A 7/1968 Krzyzanowski
3,393,808 A 7/1968 Chirchill
3,501,016 A 3/1970 Eaton
3,664,545 A 5/1972 Beesley
3,743,137 A * 7/1973 Bennett ..... 221/289
3,763,557 A 10/1973 Sewell
3,784,022 A 1/1974 Beesley, Jr.
3,922,778 A 12/1975 Aalpoel
3,923,159 A 12/1975 Taylor et al.
3,972,454 A 8/1976 Croley
4,105,126 A 8/1978 Deffner et al.
4,146,122 A * 3/1979 Harris ..... 194/253
4,205,440 A 6/1980 Morgan
4,260,072 A 4/1981 Quasarano
4,318,458 A 3/1982 Ritsema
4,382,526 A 5/1983 Stone
4,396,143 A 8/1983 Killy
4,435,026 A 3/1984 Johnson
4,467,524 A 8/1984 Ruff et al.
4,576,272 A 3/1986 Morgan, Jr.
4,598,828 A 7/1986 Young et al.
4,729,480 A 3/1988 Groover et al.
4,744,489 A 5/1988 Binder et al.
4,834,263 A 5/1989 Becze
4,869,395 A 9/1989 Rubbmark
4,911,309 A 3/1990 Stefan
4,915,571 A 4/1990 Toshihiko et al.
4,923,070 A 5/1990 Jackle et al.
4,997,106 A 3/1991 Rockola
4,998,628 A 3/1991 Ross
5,033,348 A 7/1991 Walsh
5,080,256 A 1/1992 Rockola
5,101,703 A 4/1992 Tanaka et al.
5,167,345 A 12/1992 Bleeker
5,190,155 A 3/1993 Grunwald
5,251,972 A 10/1993 Zurawin
5,289,943 A 3/1994 Powell
5,314,078 A 5/1994 Morikiyo et al.
5,328,258 A 7/1994 Scalise
5,356,033 A 10/1994 Delaney
5,372,278 A 12/1994 Leight
5,377,866 A * 1/1995 Watters, II ..... 221/194
5,390,821 A 2/1995 Markel
5,396,997 A 3/1995 Johnson
D363,174 S 10/1995 Fletcher, Sr.
5,462,198 A 10/1995 Schwimmer
5,529,207 A 6/1996 Oden et al.
5,638,988 A 6/1997 Rogers
5,685,664 A 11/1997 Parham et al.
5,740,610 A 4/1998 Ayer et al.
5,788,117 A 8/1998 Zimmanck
5,791,048 A 8/1998 Bodnar et al.
5,836,478 A 11/1998 Weiss
5,878,862 A 3/1999 Dewsnap
5,894,942 A 4/1999 Miyashita et al.
5,924,573 A 7/1999 Piraneo et al.
5,992,286 A 11/1999 Boole
5,992,652 A 11/1999 Springs
6,186,345 B1 2/2001 Robertson
6,199,720 B1 3/2001 Rudick et al.
6,206,237 B1 3/2001 Dillon et al.
6,253,930 B1 7/2001 Freidus et al.
6,267,258 B1 7/2001 Wilkerson et al.
6,393,799 B2 5/2002 Jenkins et al.
6,453,641 B1 9/2002 Puckett
6,637,604 B1 10/2003 Jay
6,786,341 B2 * 9/2004 Stinnett et al. ..... 211/59.2
6,802,433 B2 10/2004 Leykin
6,991,116 B2 1/2006 Johnson et al.
7,207,447 B2 4/2007 Medcalf et al.
7,303,095 B2 12/2007 Nagelski et al.
D588,386 S 3/2009 Johnson et al.
D595,074 S 6/2009 Johnson et al.
7,546,973 B2 6/2009 Budz et al.
7,584,854 B2 9/2009 Chandaria
7,614,543 B1 11/2009 Miller
D604,972 S 12/2009 Henry et al.
7,665,618 B2 2/2010 Jay et al.
7,681,745 B2 3/2010 Richter
7,690,518 B2 * 4/2010 Fincher et al. ..... 211/59.2
7,757,890 B2 7/2010 Alford et al.
D621,644 S 8/2010 Johnson
7,810,672 B1 10/2010 Mason et al.
7,823,733 B2 11/2010 Futori
7,841,479 B2 11/2010 Budge et al.
7,850,015 B1 12/2010 Mason
7,913,860 B2 3/2011 Merl
7,918,365 B2 4/2011 White et al.
7,922,437 B1 4/2011 Loftin et al.
7,992,747 B2 8/2011 Bauer
8,028,855 B2 10/2011 White et al.
8,047,400 B1 11/2011 Luberto et al.
8,302,809 B1 11/2012 Bogdziewicz et al.
8,308,023 B2 11/2012 Gelardi et al.
2002/0043509 A1 4/2002 Lajeunesse et al.
2003/0173322 A1 9/2003 Rushing
2004/0007546 A1 * 1/2004 Stinnett et al. ..... 211/59.2
2004/0011751 A1 1/2004 Johnson et al.
2004/0079760 A1 4/2004 Rink
2004/0262326 A1 12/2004 Christensen
2005/0092644 A1 5/2005 Cafferata
2005/0127015 A1 6/2005 Medcalf et al.
2005/0207877 A1 9/2005 Haverdink
2006/0081692 A1 4/2006 Stewart et al.
2006/0237384 A1 10/2006 Neumann et al.
2006/0243683 A1 11/2006 Onachilla et al.
2006/0278591 A1 12/2006 Tippets et al.
2007/0007221 A1 * 1/2007 Mann ..... 211/59.3
2007/0194037 A1 8/2007 Close
2008/0067188 A1 * 3/2008 White et al. ..... 221/123
2008/0245813 A1 10/2008 Johnson et al.
2009/0039040 A1 2/2009 Johnson et al.
2009/0212066 A1 8/2009 Bauer
2009/0266776 A1 10/2009 Johnson
2009/0277853 A1 11/2009 Bauer
2009/0308885 A1 12/2009 Sainato et al.
2010/0032391 A1 2/2010 Schneider et al.
2010/0096401 A1 4/2010 Sainato et al.
2010/0295424 A1 * 11/2010 Alexander ..... 312/109
2011/0121010 A1 5/2011 Loftin et al.
2011/0121011 A1 5/2011 Gelardi et al.
2011/0121022 A1 5/2011 Sholl et al.
2012/0018391 A1 1/2012 Gelardi et al.
2012/0074016 A1 3/2012 Gelardi et al.
2012/0074160 A1 3/2012 Thomas et al.
2012/0074164 A1 3/2012 Walling et al.
2012/0080513 A1 4/2012 Thomas et al.
2012/0097694 A1 4/2012 Gelardi
2012/0152970 A1 6/2012 Thomas
2012/0211522 A1 8/2012 Gelardi et al.

(56) References Cited

U.S. PATENT DOCUMENTS

| | | | |
|---|---|---|---|
| 2012/0217213 | A1 | 8/2012 | Thomas |
| 2012/0217261 | A1 | 8/2012 | Bailey et al. |
| 2012/0223090 | A1 | 9/2012 | Thomas et al. |
| 2012/0279893 | A1 | 11/2012 | Gelardi et al. |
| 2012/0285976 | A1 | 11/2012 | Bogdziewicz et al. |
| 2012/0285977 | A1 | 11/2012 | Bates et al. |

FOREIGN PATENT DOCUMENTS

| | | | |
|---|---|---|---|
| DE | 29808673 | | 11/1998 |
| DE | 19808162 | | 9/1999 |
| DE | 20111307 | | 10/2001 |
| DE | 202007012114 | | 11/2007 |
| FR | 2415051 | | 8/1979 |
| GB | 2190906 | | 12/1978 |
| GB | 2303624 | | 2/1997 |
| JP | 03105494 | A | 5/1991 |
| JP | 03133737 | A | 6/1991 |
| JP | 03198192 | A | 8/1991 |
| JP | 03273469 | A | 12/1991 |
| JP | 03273470 | A | 12/1991 |
| JP | 03273471 | A | 12/1991 |
| JP | 03273472 | A | 12/1991 |
| JP | 03273474 | A | 12/1991 |
| JP | 03273476 | A | 12/1991 |
| JP | 03273477 | A | 12/1991 |
| JP | 03273480 | A | 12/1991 |
| JP | 03273482 | A | 12/1991 |
| JP | 03273483 | A | 12/1991 |
| JP | 04086985 | A | 3/1992 |
| JP | 04115392 | A | 4/1992 |
| JP | 04137194 | A | 5/1992 |
| JP | 05004640 | A | 1/1993 |
| JP | 05174239 | A | 7/1993 |
| JP | 05346984 | A | 12/1993 |
| JP | 08161611 | A | 6/1996 |
| JP | 09027066 | A | 1/1997 |
| JP | 09102065 | A | 4/1997 |
| JP | 09282537 | A | 10/1997 |
| JP | 09311971 | A | 12/1997 |
| JP | 10269421 | A | 10/1998 |
| JP | 11011471 | A | 1/1999 |
| JP | 11171264 | A | 6/1999 |
| JP | 11191175 | A | 7/1999 |
| JP | 11328513 | A | 11/1999 |
| JP | 2001072076 | A | 3/2001 |
| JP | 2001206358 | A | 7/2001 |
| JP | 2003327243 | A | 11/2003 |
| JP | 2004017970 | A | 1/2004 |
| JP | 2005338910 | A | 12/2005 |
| JP | 04157593 | B1 | 10/2008 |
| WO | WO 9106076 | | 5/1991 |
| WO | WO 9321074 | | 10/1993 |
| WO | WO 9423619 | | 10/1994 |
| WO | WO 0054632 | | 9/2000 |
| WO | WO 2004014755 | | 2/2004 |
| WO | WO 2004113808 | | 12/2004 |
| WO | WO 2009138538 | | 11/2009 |
| WO | WO 2011025483 | | 3/2011 |
| WO | WO 2011109350 | | 9/2011 |

* cited by examiner

PRODUCT DISPENSING SYSTEM WITH DISPENSER DOOR

PRIORITY

This application is a continuation-in-part of U.S. Ser. No. 13/595,316 filed on Aug. 27, 2012, the entire contents of which are hereby incorporated herein by reference.

FIELD

This application relates to the dispensing of products from packaging containers and, more particularly, to dispensers for dispensing products initially provided in packaging containers.

BACKGROUND

Products are typically shipped to retailers in bulk by enclosing multiple individual product units in a container, such as a carton or box. For example, canned beverages may be shipped to a retailer in a carton containing twelve or more individual cans. When the products are to be sold individually, the retailer must remove the individual product units from the carton and stack them on a display, such as a shelf.

Alternatives to the traditional package-ship-unpack-display model have been developed in an effort to improve operating efficiency. For example, U.S. Pat. No. 7,922,437 issued on Apr. 12, 2011, the entire contents of which are incorporated herein by reference, discloses a system for dispensing and displaying products packaged in a container. Specifically, the system includes a frame having a support structure, a product display area and an opening tool. The frame may be positioned on a retailer's shelf and loaded with product simply by placing a container comprising multiple units of product onto the support structure of the frame. As the container is being placed onto the support structure, the opening tool of the frame opens the container in such a manner that product rolls from the container and down to the product display area of the frame under the force of gravity. When one product is removed from the product display area, another product from within the dispenser frame moves down to the product display area under the force of gravity.

Furthermore, multiple product dispensers may be positioned on a single display support surface, such as store shelves. For example, a plurality of dispensers may be configured in a side-by-side orientation on a shelf or similar support surface and a second plurality of dispensers may be configured in a side-by-side orientation directly above on an upper support surface. Thus it may be advantageous to optimize the space provided for the display area by maximizing the number of dispensers on a given support surface.

Despite advances already made in the field, those skilled in the art continue with research and development efforts directed to apparatus and systems for dispensing products initially provided in packaging containers.

SUMMARY

In one aspect, the disclosed product dispensing system may include a plurality of dispensing frames, each frame having a front end and a rear end, and including an upper support deck extending between the front end and the rear end, a lower support deck positioned below the upper support deck, the lower support deck extending between the front end and the rear end and defining a product display area, and a dispenser door connected to a pair of outermost frames of said plurality of frames proximate the upper support decks.

In another aspect, the disclosed product dispensing system may include a plurality of containers, each initially housing a plurality of products, a plurality of frames, each having longitudinally opposed front and rear ends and including an upper support deck extending at least partially between the front and rear ends, a lower support deck positioned below the upper support deck, the lower support deck defining a product display area, an opening tool associated with each frame and arranged to open the containers when the containers are moved longitudinally along the upper support decks from the front end toward the rear end to allow the products to be at least partially dispensed from the containers into the product display areas, and a door connected to a pair of outermost frames of the plurality of frames proximate the front ends to access the upper support decks.

In yet another aspect, disclosed is a method for dispensing a plurality of product initially provided in a container. The method may include the steps of (1) providing a plurality of dispensers, each including a frame having a front end and a rear end, the frame including an upper support deck extending at least partially between the front end and the rear end, a lower support deck positioned below the upper support deck, the lower support deck defining a product display area, and a door connected to a pair of outermost frames of the plurality of frames proximate the front end to access the upper support deck (2) forming an opening in the containers, and (3) positioning the containers on the upper support decks behind the door.

Other aspects of the disclosed product dispensing system and method will become apparent from the following detailed description, the accompanying drawings and the appended claims.

DETAILED DESCRIPTION

Figure 1:
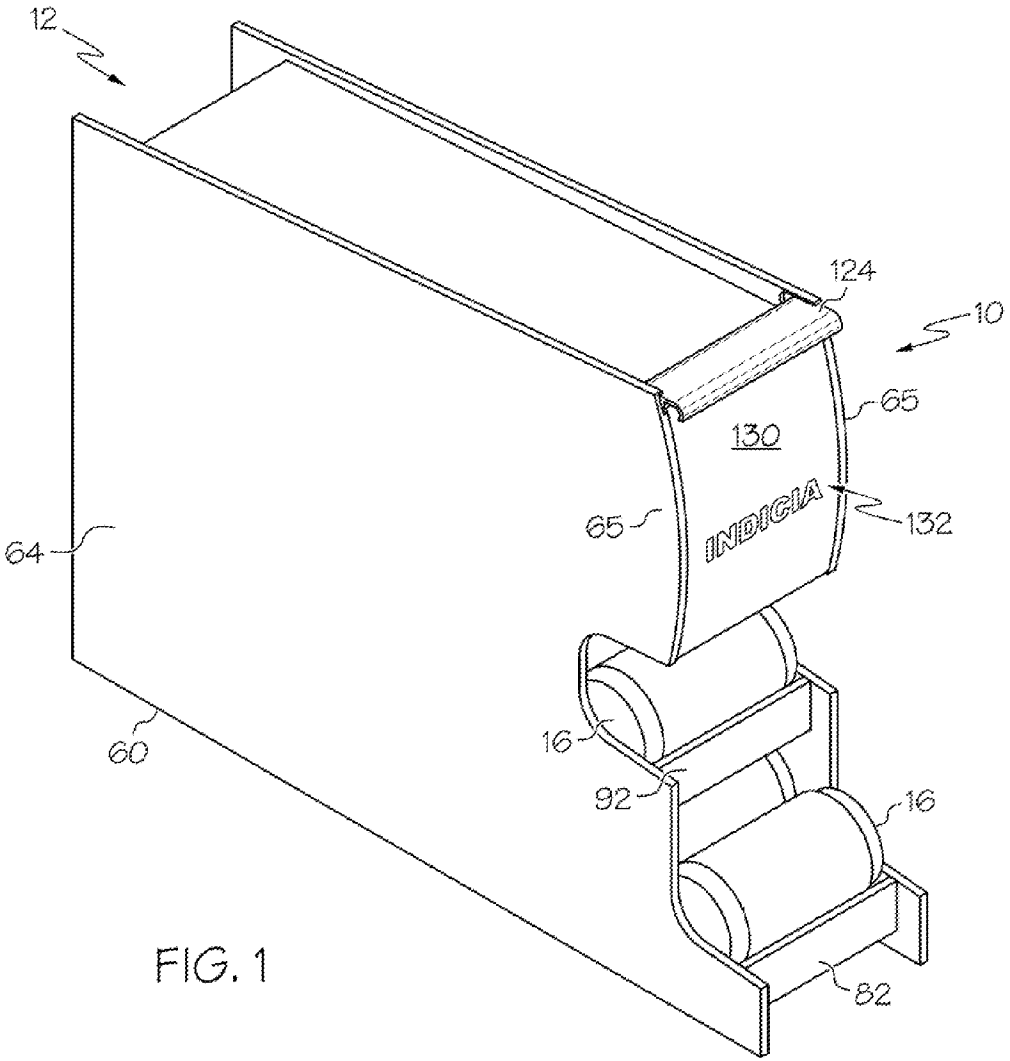
FIG. 1 is a front perspective view of one aspect of a disclosed product dispensing system with dispenser door.
Figure 2:
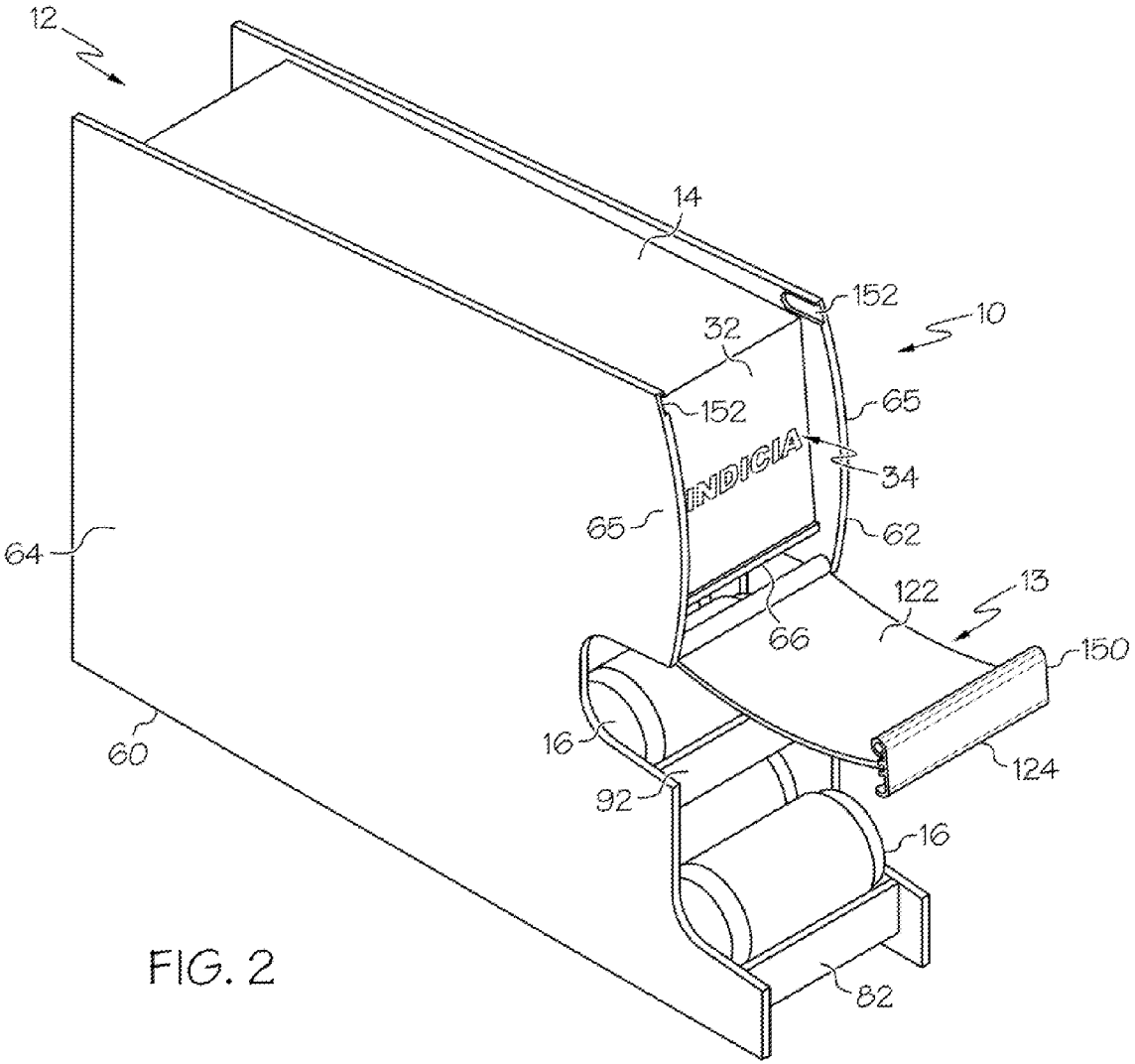
FIG. 2 is a front perspective view of the product dispensing system of FIG. 1 depicted with a dispenser door in an open position.
Figure 3:
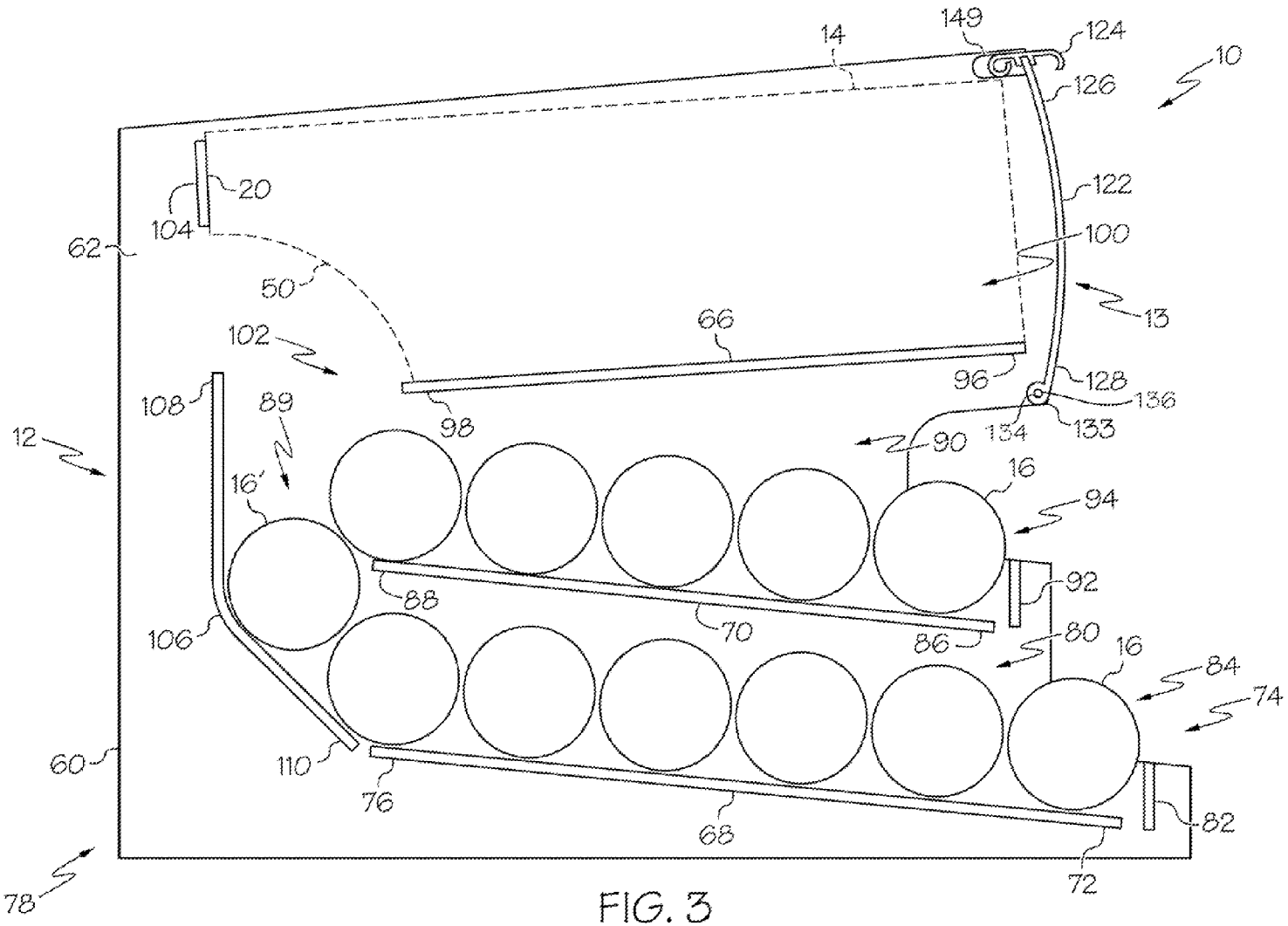
FIG. 3 is a side elevation view, in section, of the product dispensing system of FIG. 1.

Referring to FIGS. 1 through 3, one aspect of the disclosed product dispensing system with dispenser door, generally designated 10, may include a dispenser 12, a dispenser door 13, and a container 14. The container 14, as described in more detail herein, may initially house multiple units of product 16, such as cans (e.g., canned soft drinks), jars (e.g., jarred soup) or bottles (e.g., bottled sauce). The products 16 may be released from the container 14 into the dispenser 12 when the container 14 is opened and loaded onto the dispenser 12.

Figure 4:
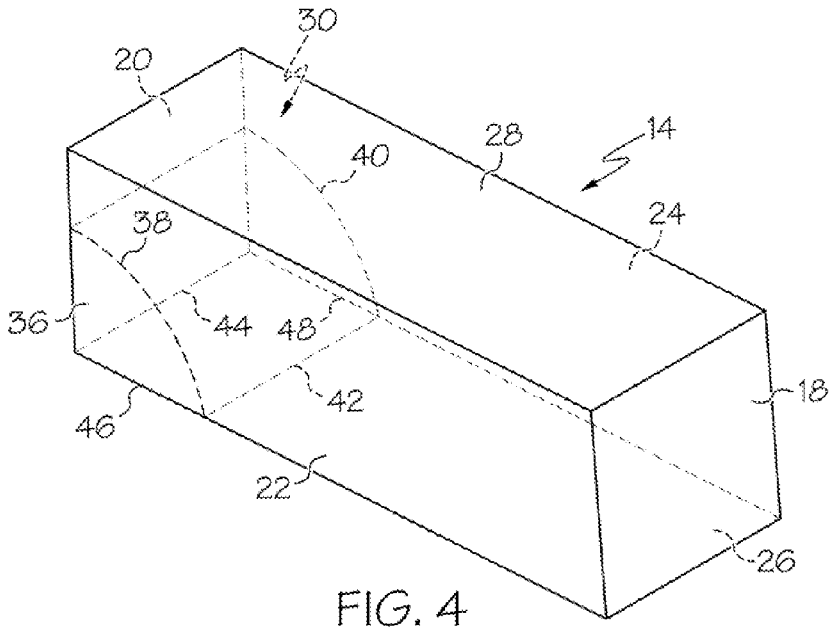
FIG. 4 is a front perspective view of a container of the product dispensing system of FIG. 2.
Figure 5:
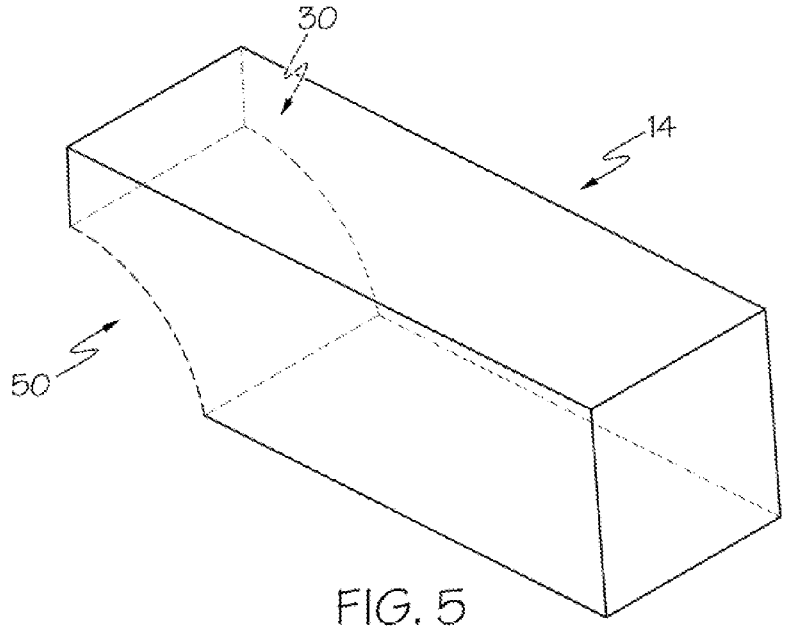
FIG. 5 is a front perspective view of the container of FIG. 4 shown in an open configuration

Referring next to FIGS. 4 and 5, the container 14 may be any container capable of initially housing the products 16 and beneficially interacting with the dispenser 12. For example, the container 14 may be a paperboard carton or a corrugated box having six walls 18, 20, 22, 24, 26, 28 that define an internal volume 30 for receiving the products 16. Opposed walls 18, 20 may define the front wall 18 and the rear wall 20 of the container 14. Opposed walls 22, 24 may define the left side wall 22 and the right side wall 24 of the container 14. Opposed walls 26, 28 may define the lower base wall 26 and the upper wall 28 of the container 14.

In accordance with well-established techniques, the container 14 may be assembled on a container machine using a container blank that has been pre-cut from a sheet of stock material. As one example, the stock material may be a paperboard-based material, such as C1S paperboard, which may have a coating (e.g., clay) on a first major surface thereof, which may form the outer surface of the container 14, and an uncoated second major surface. As another example, the stock material may be C2S paperboard, which may have a coating (e.g., clay) on both major surfaces thereof. Optionally, the outer surface 32 (illustrated in FIG. 2) of the container 14 may be marked with various container indicia 34 (FIG. 2), such as printed text and graphics, for example to identify the type of product 16 or the manufacturer of the product 16.

Still referring to FIG. 4, the container 14 may include a removable opening feature 36. The removable opening feature 36 may be defined by weakened severance lines 38, 40, 42, 44, 46, 48 formed in the rear wall 20, left side wall 22, right side wall 24 and the base wall 26 of the container 14. The weakened severance lines 38, 40, 42, 44, 46, 48 may be formed by weakening the container 14, such as with score lines, perforations or zipper-like cuts, to facilitate tearing of the container 14 along the weakened severance lines 38, 40, 42, 44, 46, 48.

Thus, as shown in FIG. 5, the removable opening feature 36 may be removed from the container 14 to form an opening 50 to access the internal volume 30 of the container 14. The opening 50 may extend generally laterally between the left side wall 22 and the right side wall 24 of the container 14 and may be positioned proximate the rear wall 20 of the container 14, such that the products 16 (FIG. 1) may exit the container 14 through the opening 50. Those skilled in the art will appreciate that the step of removing the removable opening feature 36 from the container 14 may be performed prior to loading the container 14 onto the dispenser 12.

Referring back to FIGS. 1 through 3, each dispenser 12 may include a frame 60 that supports the container 14 in a desired configuration, as illustrated in FIGS. 2 and 3 (the container 14 is shown in broken lines in FIG. 3). The frame 60 may include a first (e.g., right) side wall 62, a second (e.g., left) side wall 64, an upper support deck 66, a lower support deck 68 and one or more intermediate support decks 70 (only one intermediate support deck 70 is shown by example in FIGS. 1 through 3). The right side wall 62 may be laterally spaced from the left side wall 64, and may be generally parallel with the left side wall 64.

The lower support deck 68 may laterally extend between the right side wall 62 and the left side wall 64 of the frame 60 and may include a front end 72 that longitudinally extends toward the front end 74 of the frame 60 and a rear end 76 that longitudinally extends toward the rear end 78 of the frame 60. Therefore, the lower support deck 68 and the side walls 62, 64 may define a lower level 80 of the frame 60.

The lower support deck 68 may be inclined from the front end 72 to the rear end 76 (i.e., the rear end 76 may be elevated relative to the front end 72) such that products 16 deposited proximate the rear end 76 of the lower support deck 68 roll down to the front end 72 of the lower support deck 68 under the force of gravity. The extent of the incline of the lower support deck 68 may be dictated by, among other things, the coefficient of friction of the material used to form the frame 60 and the shape of the products 16 to be dispensed by the dispenser 12.

A lower stop 82 may be positioned proximate the front end 72 of the lower support deck 68 to prevent products 16 from rolling beyond the front end 72 of the lower support deck 68. Therefore, the stop 82 may collect products 16 at the front end 72 of the lower support deck 68, thereby defining a first product display area 84 proximate the front end 72 of the lower support deck 68.

The intermediate support deck 70 may be positioned between the upper support deck 66 and the lower support deck 68. The intermediate support deck 70 may laterally extend between the right side wall 62 and the left side wall 64 of the frame 60 and may include a front end 86 that longitudinally extends toward the front end 74 of the frame 60 and a rear end 88 that longitudinally extends toward, but not to, the rear end 78 of the frame 60. Therefore, the intermediate support deck 70 and the side walls 62, 64 may define an intermediate level 90 of the frame 60.

The spacing between the rear end 88 of the intermediate support deck 70 and the rear end 78 of the frame 60 may define an intermediate opening 89, which may function as a chute to allow products 16 to move from the intermediate level 90 down to the lower level 80 of the frame 60 under the force of gravity.

The intermediate support deck 70 may be inclined from the front end 86 to the rear end 88 (i.e., the rear end 88 may be elevated relative to the front end 86) such that products 16 deposited proximate the rear end 88 of the intermediate support deck 70 roll down to the front end 86 of the intermediate support deck 70 under the force of gravity. The extent of the incline of the intermediate support deck 70 may be dictated by, among other things, the coefficient of friction of the material used to form the frame 60 and the shape of the products 16 to be dispensed by the dispenser 12.

An intermediate stop 92 may be positioned proximate the front end 86 of the intermediate support deck 70 to prevent products 16 from rolling beyond the front end 86 of the intermediate support deck 70. Therefore, the stop 92 may collect products 16 at the front end 86 of the intermediate support deck 70, thereby defining a second product display area 94 proximate the front end 86 of the intermediate support deck 70. The second product display area 94 may be longitudinally displaced (e.g., inwardly) relative to the first product display area 84. The second product display area 94 may also be vertically displaced (e.g., upwardly) relative to the first product display area 84.

The upper support deck 66 may laterally extend between the right side wall 62 and the left side wall 64 of the frame 60 and may include a front end 96 that longitudinally extends toward the front end 74 of the frame 60 and a rear end 98 that longitudinally extends toward, but not to, the rear end 78 of the frame 60. Therefore, the upper support deck 66 and the side walls 62, 64 may define an upper level 100 of the frame 60.

The spacing between the rear end 98 of the upper support deck 66 and the rear end 78 of the frame 60 may define an upper opening 102, which may function as a chute to allow products 16 to move from the upper level 100 down to the intermediate 90 and lower 80 levels of the frame 60 under the force of gravity.

The upper support deck 66 may be declined from the front end 96 to the rear end 98 (i.e., the front end 96 may be elevated relative to the rear end 98). Therefore, products 16 supported on the upper support deck 66 may roll under the force of gravity down to the rear end 98 of the upper support deck 66, through the opening 102, to the lower and intermediate levels 80, 90 of the frame 60 and, ultimately, to the first product display area 84 and the second product display 94.

Optionally, a container stop 104 may be connected proximate the rear end 78 of the frame 60. The stop 104 may laterally extend between the right side wall 62 and the left side wall 64 of the frame 60 proximate the upper level 100 of the frame 60 to inhibit rearward horizontal movement of the container 14 along the upper support deck 66 beyond the stop 104. Alternatively, the stop 104 may extend from the rear end 78 of the frame 60 into the upper level 100 of the frame 60 to inhibit rearward horizontal movement of the container 14 along the upper support deck 66 beyond the stop 104.

A guide 106 may be connected proximate the rear end 78 of the frame 60. The guide may laterally extend between the right side wall 62 and the left side wall 64 of the frame 60 and may include a generally vertical upper end 108 that extends toward the upper support deck 66 and a declined lower end 110 that extends toward the rear end 76 of the lower support deck 68. The guide 106 may extend from proximate the upper opening 102 in the upper level 100 defined by the upper support deck 66, down through the intermediate opening 89 in the intermediate level 90 defined by the intermediate support deck 70 and, ultimately, down to the lower level 80 proximate the rear end 76 of the lower support deck 68.

Thus, the guide 106 may receive products 16 exiting through the opening 50 in the container 14 and may guide the products 16 down proximate the rear end 76 of the lower support deck 68, thereby allowing the products 16 guided to the lower level 80 to ultimately move to the first product display area 84. Once the lower level 80 of the frame 60 has been filled with products 16 such that the opening 89 in the intermediate level 90 is bridged by a product 16' (FIG. 3), the guide 106 may guide the products 16 down proximate the rear end 88 of the intermediate support deck 70, thereby allowing the products 16 guided to the intermediate level 90 to ultimately move to the second product display area 94.

A dispenser door 13 may be connected to the frame 60 proximate the front end 74 to access the upper support deck 66. The door 13 may laterally extend between the right side wall 62 and the left side wall 64 of the frame 60 proximate the upper level 100 of the frame 60 to close off the upper level 100 when in a closed position (FIGS. 1 and 3). The door 13 may be pivotably opened about a lower end to provide access to the upper support deck 66 for loading the opened container 14 onto the dispenser 12.

The dispenser door 13 may include a generally flat upper edge configured to be in a coplanar relationship with an upper edge of the front end 74 of the frame 60 and at least extending to an upper edge of the container 14 proximate the front end 74 of the frame 60. A door handle 124 may protrude outwardly from the upper edge of the door 13, and may be coplanar with the top surface of the door 13. Alternatively, the door handle 124 may be positioned below the upper edge of the door 13. Thus, the position of the handle 124 relative to the upper edge of the door 13 allows for manual opening and closing of the door 13 from the front and does not require engagement of the door 13 from above or about the upper edge of the door 13. This arrangement may allow for a minimal required offset distance between the upper edge of the front end 74 of the frame 60 and the upper edge of the door 13 relative to another structure positioned directly above the dispenser 12, such as an additional dispenser 12 or dispenser support.

The door 13 may include a door panel 122 and the door handle 124 connected to an upper end 126 of the door panel 122. A lower end 128 of the door panel 122 may be pivotably connected at opposing lateral sides to the right side wall 62 and the left side wall 64, respectively. The upper end 126 of the door panel 122 may be releasably secured at opposing lateral sides between the right side wall 62 and the left side wall 64, respectively.

Figure 6:
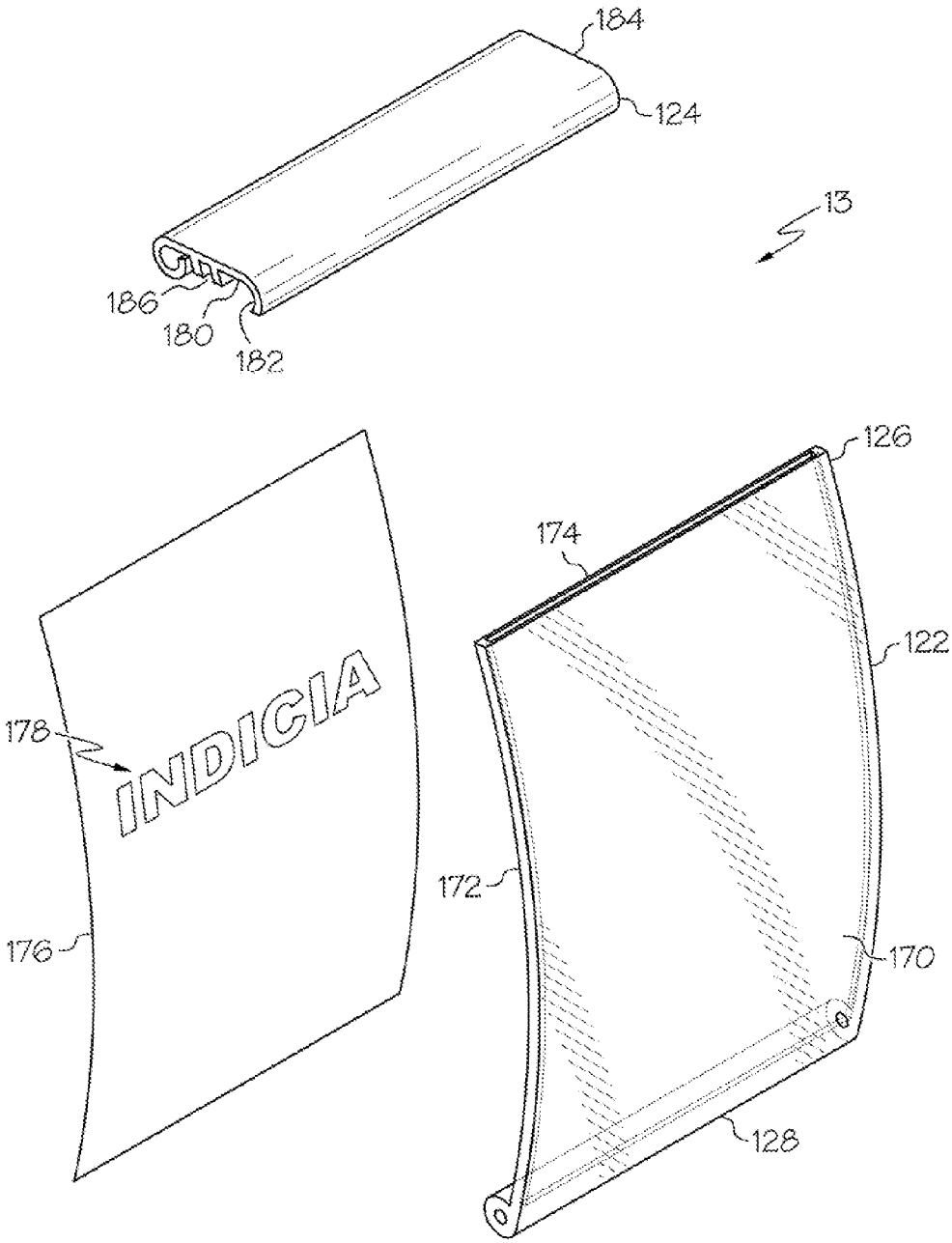
FIG. 6 is a front perspective view of the dispenser door of the disclosed product dispensing system.

The door panel 122 may have a flat or curved profile, which suitably matches an upper edge 65 of the front end 74 of the frame 60 (FIGS. 1 and 2). Optionally, the outer surface 130 of the door panel 122 may be marked with various door panel indicia 132 (FIG. 1), such as printed text and graphics, for example to identify the container 14, the type of product 16, or the manufacturer of the product 16 loaded within the dispenser. Alternatively, the door panel 122 may be transparent to provide visual access to the container indicia 34 displayed on the container outer surface 32 (FIG. 2). Alternatively, the door panel 122 may be formed by a transparent front panel wall 170 and a parallel rear panel wall 172 defining an internal slot 174 (FIG. 6). The slot 174 may be suitably sized to insertably receive a product placard 176 or similar product identifying card or sign. In accordance with well-established techniques, the placard 176 may be formed from a sheet of stock material or plastic and may be marked with various placard indicia 178, such as printed text and graphics, for example to identify the container 14, the type of product 16, or the manufacturer of the product 16 loaded within the dispenser 12.

The lower end 128 of the door panel 122 may be pivotably connected between the right side wall 62 and the left side wall 64 of the frame 60 by a hinge feature 133, such that the door 13 pivots downwardly about the hinge feature 133 into the open position (FIG. 2). The lower end 128 of the door panel 122 may include a door hinge feature 134 pivotably connected to side wall hinge features 136 disposed on oppositely facing interior surfaces of the right side wall 62 and left side wall 64.

The upper end 126 of the door panel 122 may be operatively connected between the right side wall 62 and the left side wall 64 of the frame 60 by an interference friction fit, a hook, a latch, a pin or similar retaining feature 149 to releasably secure the door 13 in the closed position (FIGS. 1 and 3). The upper end 126 of the door panel 122 may include a door retaining feature 150 operatively connectable to side wall retaining features 152 disposed on oppositely facing interior surfaces of the right side wall 62 and the left side wall 64.

At this point, those skilled in the art will appreciate that various structural features may be utilized to form the pivotal connection of the hinge feature 133 between the lower end 128 of the door panel 122 and the side walls 62, 64 of the frame 60 and the operative connection of the retaining feature 149 between the upper end 126 of the door panel 122 and the side walls 62, 64 of the frame 60 such as those described in U.S. Ser. No. 13/595,316 filed on Aug. 27, 2012, the entire contents of which are incorporated herein by reference, and that various alternative features may be used without departing from the scope of the present disclosure.

For example, the door hinge feature 134 may be a pair of apertures formed through opposing outside edges of the lower end 128 of the door panel 122. The side wall hinge features 136 may be horizontally aligned protrusions extending outwardly from the interior surfaces of the right side wall 62 and left side wall 64. The apertures may receivably engage the protrusions to pivotably connect the door 13 to the frame 60. As another example, the door hinge feature 134 may be an integral tubular member extending along an entire bottom edge of the lower end 128 of the door panel 122. The side wall hinge features may be horizontally aligned side wall apertures disposed completely through the right side wall 62 and left side wall 64. When ends of the tubular member are aligned with the side wall apertures between the side walls 62, 64, a pin may extend laterally from the aperture of the right side wall 62 to the aperture of the left side wall 64 entirely through the tubular member to pivotably connect the door 13 to the frame 60. As another example, the door hinge feature 134 may be a pair of protrusions extending outwardly from opposing sides of the lower end 128 of the door panel 122. The side wall hinge features may be horizontally aligned side wall apertures disposed partially through oppositely facing interior surfaces of the right side wall 62 and the left side wall 64 or completely through the right side wall 62 and left side wall 64. The apertures of the side walls 62, 64 may receivably engage the protrusions of the door panel 122 to pivotably connect the door 13 to the frame 60.

For example, the door retaining feature 150 may be a coiled spring and the side wall retaining features may be a pair of horizontally aligned grooves disposed partially through oppositely facing interior surfaced of the right side wall 62 and left side wall 64. The spring may include at least one elongated coil of resilient spring material protruding outwardly from and extending along a rear side of the upper end 126 of the door panel 122. As another example, a pair of shortened coiled springs may extend outwardly from opposing ends of the rear side of the upper end of the door panel 122. The grooves may have a width slightly smaller than a diameter of the coil of the spring in an uncompressed condition. Upon insertion of the spring within the grooves, the spring is slightly compressed such that the outer surface of the spring is in contact with the upper and lower surfaces of the groove to releasably retain the door 13 in the closed position. As another example, the door retaining feature 150 may be a pair of recesses formed through opposing outside edges of the upper end 126 of the door panel 122. The side wall retaining features 152 may be horizontally aligned protrusions extending outwardly from the interior surfaces of the right side wall 62 and left side wall 64 of the frame 60. The recesses may receivably engage the protrusions to releasably retain the door 13 in the closed position. As another example, the door retaining feature 150 may be a pair of protrusions extending outwardly from opposing sides of the upper end 128 of the door panel 122. The side wall retaining feature 152 may be a pair of horizontally aligned side wall recesses disposed partially through oppositely facing interior surfaces of the right side wall 62 and the left side wall 64. The recesses of the side walls 62, 64 may receivably engage the protrusions of the door panel 122 to releasably retain the door 13 in the closed position.

As yet another example, a spring hinge may be used as the hinge feature 133 to provide the pivotal connection of the door panel 122 to the frame 60 and as the retaining feature 149 to releasably secure the door panel 122 in the closed position through a spring-force bias.

Referring to FIG. 6, the handle 124 protrudes outwardly from and extends along a front side of the upper end 126 of the door panel 122. The handle 124 may include a stand-off 180 disposed generally perpendicularly to the upper end 126 of the door panel 122 and a lip 182 extending generally downwardly from an end of the stand-off 180 opposite the door panel 122. The lip 182 may be straight or curved to provide a grip recess suitably sized to receive at least one human finger. An interior surface of the lip 182, facing the door panel 122 provides a contact surface in order to manually pivot the door 13 into the open position. The interior surface of the lip 182 may also include a textured, knurled, or contoured surface to increase the coefficient of friction between the lip 182 and the finger or fingers.

In one aspect of the door 13, the handle 124 and the door retaining feature 150 may be a unitary member 184 connected to a top edge of the upper end 126 of the door panel 122. The top surfaces of the handle 124 and door retaining feature 150 may form a coplanar unitary top surface and the bottom surfaces of the handle 124 and door retaining feature 150 may form a coplanar unitary bottom surface. A channel 186 may longitudinally extend along the unitary bottom surface to receivably connect to the top edge of the upper end 126 of the door panel 122. The unitary member 184 may be easily removed and replaced if either the handle 124 or the door retaining feature 150 were to become damaged or otherwise fail without the need to replace the entire door 13. The unitary member 184 may also be removed to insert, remove, or replace the placard 176.

The product dispensing system 10 may be assembled by opening the container 14 (e.g., tearing away the removable opening feature 36 at the severance lines 38, 40, 42, 46, 48), opening the door 13, and urging the opened container 14 along the upper support deck 66 of the frame 60 until the rear wall 20 of the container 14 comes into abutting engagement with the stop 104. With the opened container 14 loaded onto the dispenser 12, the force of gravity may urge the products 16 housed in the container 14 through the opening 50 in the container 14, down through the opening 102 in the upper level 100 of the frame 60 and, ultimately, to the first and second product display areas 84, 94. With the door 13 in the closed position, the upper level 100 and container 14 are discreetly out of view.

Another aspect of the disclosed dispenser system 10 may include a dispenser having one or more opening tools (not shown). The opening tools may be positioned in the upper level 100 of the frame 60 to form an opening in the container as the container is loaded onto the frame 60, thereby releasing products 16 from the container into the dispenser 12. The type of opening tools used as well and the position of the opening tools relative to the frame 60 may depend upon the configuration of the container, among other things. At this point, those skilled in the art will appreciate that opening tools are only one specific example of suitable opening tools, and that various alternative opening tools may be used without departing from the scope of the present disclosure. For example the opening tools may be cutting elements that inwardly protrude from the side walls 62, 64 proximate the rear end 98 of the upper support deck 66 to sever a plurality of severance lines disposed on certain styles of containers to release an access door, as described in U.S. Ser. No. 13/184,639 filed on Jul. 18, 2011, the entire contents of which are incorporated herein by reference. As another example, the opening tool may include a cutting element positioned to form access panels in the container that open laterally outward, as described in U.S. Pat. No. 7,922,437 (discussed above). As another example, the opening tool may include a forward-protruding catch element, such as the forward-protruding catch element disclosed in U.S. Ser. No. 12/891,391 filed on Sep. 27, 2010, the entire contents of which are incorporated herein by reference, or the forward-protruding catch element disclosed in U.S. Ser. No. 13/032,734 filed on Feb. 23, 2011, the entire contents of which are incorporated herein by reference. As yet another example, the opening tool may include a rear-protruding catch element, such as the rear-protruding catch element disclosed in U.S. Ser. No. 12/970,683 filed on Dec. 16, 2010, the entire contents of which are incorporated herein by reference.

Alternatively, the product dispensing system 10 may be assembled to dispense products 16 by positioning the container onto the front end 96 of the upper support deck 66 of the frame 60 and urging the container along the upper support deck 66 toward the stop 104. As the container moves relative to the opening tools, the opening tools may sever the one or more severance lines of the container, thereby allowing an access panel to pivot relative to the base wall about a preformed pivot line. As the container continues to move rearward, the access panel may drop through the opening 102 in the upper level 100 of the frame 60 to form an opening in the container, thereby allowing products 16 in the container to exit the container through the opening under the force of gravity. As products 16 exit the container, the guide 106 may guide the products 16 down through the opening 102 in the upper level 100 of the frame 60 and, ultimately, to the first and second product display areas 84, 94.

In one implementation of a plurality of dispenser systems 10, the handle 124 allows for the door 13 to be easily opened manually irrespective of the amount of space between the top of the dispenser 12 of a lower dispenser system 10 supported on a lower support surface 17 and the bottom edge of an upper support surface 17 positioned directly above the lower support surface 17. The minimal offset distance between the top of the lower dispenser system 10 and the bottom of the upper support surface 17 may make it difficult to reach between the upper end of the dispenser frame 60 of the lower dispenser system 10 and the bottom of the upper support surface 17 in order to open the door 13. As described above, the frontward or coplanar position of the handle 124 relative to the upper edge of the door 13 and the rearward or coplanar position of the retaining feature 149 relative to the upper edge of the door 13 overcomes this problem.

In use, a plurality of product dispensers 12 may be positioned in a side-by-side orientation, a stacked orientation, or both. It can be appreciated that the dispensing system 10 may be positioned on and supported by any suitable generally horizontal display support surface 17, such as a table top, a counter top, a shelf, or a rack of shelves. When a plurality of dispensers 12 are configured in a side-by-side configuration, it may be desirable to access the upper levels 100 and upper support decks 66 of the plurality of dispensers 12 without the need to open the door 13 of each individual dispenser frame 60.

Figure 7:
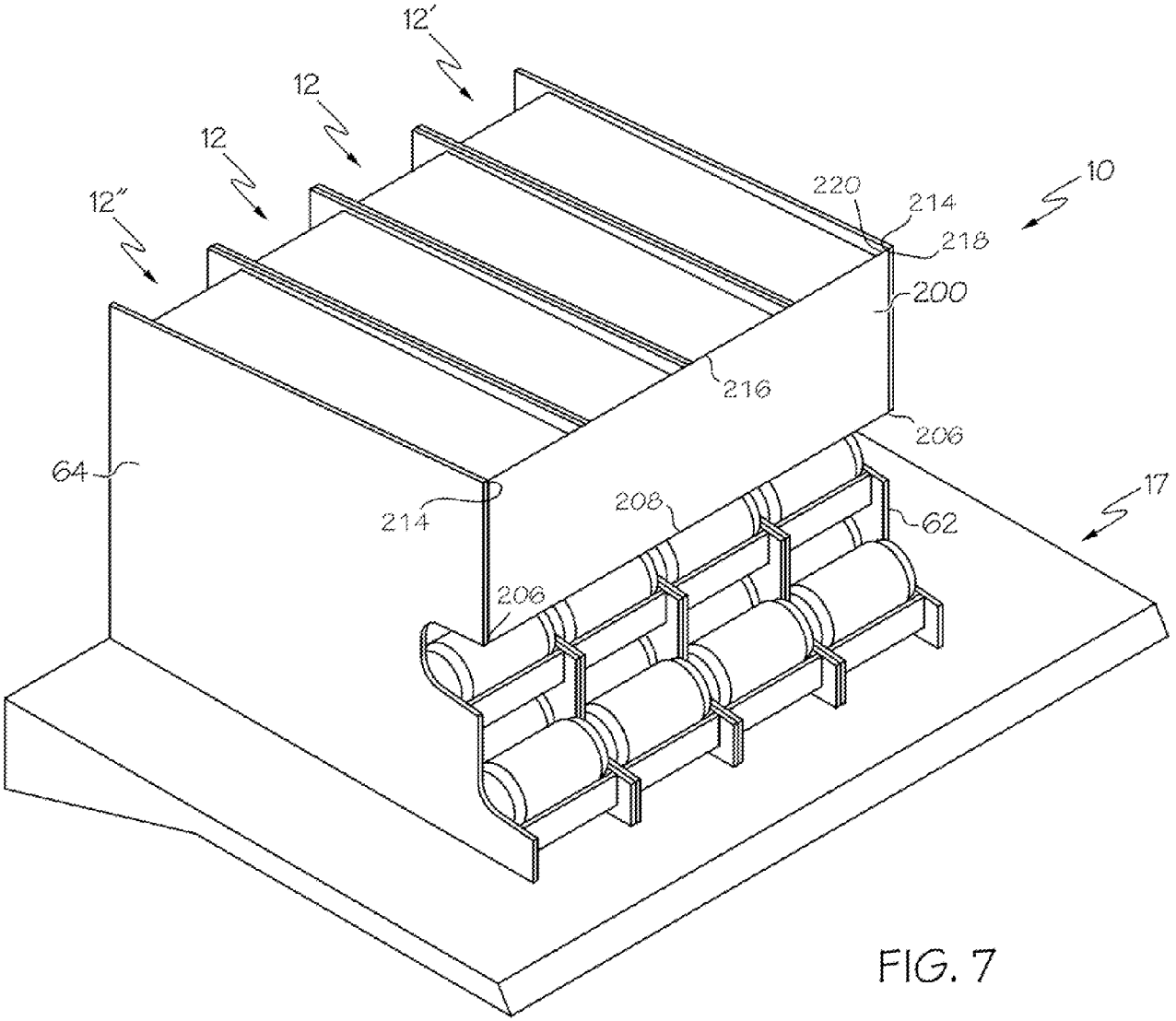
FIG. 7 is a front perspective view of another aspect of the disclosed product dispensing system with dispenser door.

Referring next to FIG. 7, another aspect of the disclosed product dispensing system with dispenser door 10 may include a plurality of dispensers 12 configured in a side-by-side orientation upon the support surface 17 having a single dispenser door 200 which covers the upper levels 100 of a plurality of dispensers 12. The dispenser door 200 may be connected to the frame 60 of outermost dispensers 12', 12" proximate the front ends 74 to access the upper support decks 66. The door 200 may laterally extend between the right side wall 62 of the right outermost dispenser 12' and the left side wall 64 of the left outermost dispenser 12" proximate the upper level 100 of the frame 60 of each of the plurality of dispensers 12 to close off the upper level 100 when in the closed position. The door 200 may be pivotably opened about a lower end to provide access to the upper support decks 66 for loading a plurality of opened containers 14 onto the dispensers 12.

The dispenser door 200 may include substantially similar features as described above for the door 13, including a door panel 202 and a door handle 204. The door handle 204 may protrude outwardly from the upper edge of the door panel 202 and may be coplanar with the top surface of the door panel 202 as described above and shown in FIG. 6. Alternatively, the door handle 204 may be positioned below the upper edge of the door panel 202. Thus, the position of the handle 204 relative to the upper edge of the door 200 allows for manual opening and closing of the door 200 from the front and does not require engagement of the door 200 from above or about the upper edge of the door 200. This arrangement may allow for a minimal required offset distance between the upper edge of the front end 74 of the frame 60 and the upper edge of the door 200 relative to another structure positioned directly above the dispenser 12, such as an additional dispenser 12 or dispenser support 17. Alternatively, the handle 204 may include a groove 222 disposed along the top surface of the door panel 202 and extending from end to end (FIG. 8). The groove 222 may be suitably sized to be engaged by a human finger or fingers to manually pivot the door 200 into the open position.

A lower end 208 of the door panel 202 may be pivotably connected at opposing lower lateral sides to the right side wall 62 of the right dispenser 12' and to the left side wall 64 of the left dispenser 12" by a hinge feature 206, such that the door 200 pivots downwardly about the hinge feature 206 into the open position. The lower end 208 of the door panel 202 may include a door hinge feature 210 pivotably connected to side wall hinge features 212 disposed on inwardly facing surfaces of the right side wall 62 of the right dispenser 12' and the left side wall 64 of the left dispenser 12".

An upper end 216 of the door panel 202 may be operatively connected between the right side wall 62 of the right dispenser 12' and the left side wall 64 of the left dispenser 12" by an interference friction fit, a hook, a latch, a pin, or similar retaining feature 214 to releasably secure the door 200 in the closed position. The upper end 216 of the door panel 202 may include a door retaining feature 218 operatively connected to side wall retaining features 220 disposed on inwardly facing surfaces of the right side wall 62 of the right dispenser 12' and the left side wall 64 of the left dispenser 12".

In certain aspects of the disclosed product dispensing system 10, the side wall hinge features 212 and the side wall retaining features 220 may be integral to the frames 60 of the right dispenser 12' and the left dispenser 12". In such an embodiment, the front upper end of the right side wall 62 of the right dispenser 12' and the front upper end of the left side wall 64 of the left dispenser 12" may extend past the front upper ends of the inner plurality of side walls 62, 64, such that the inner plurality of side walls 62, 64 do not interfere with the door 200 when in the closed position.

Figure 8A:
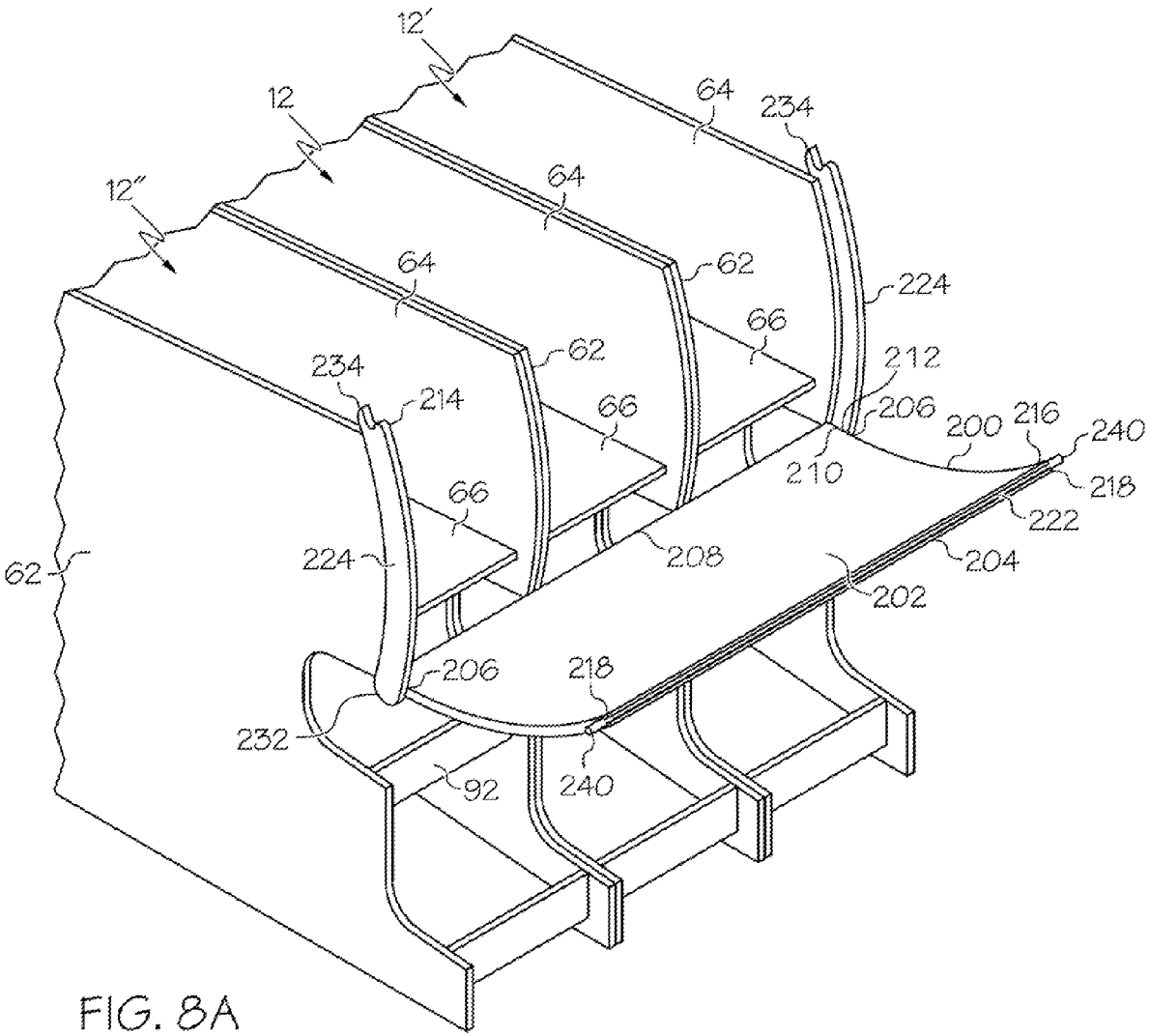
FIG. 8A is a partial front perspective view of another aspect of the disclosed product dispensing system showing a plurality of dispensers.
Figure 8B:
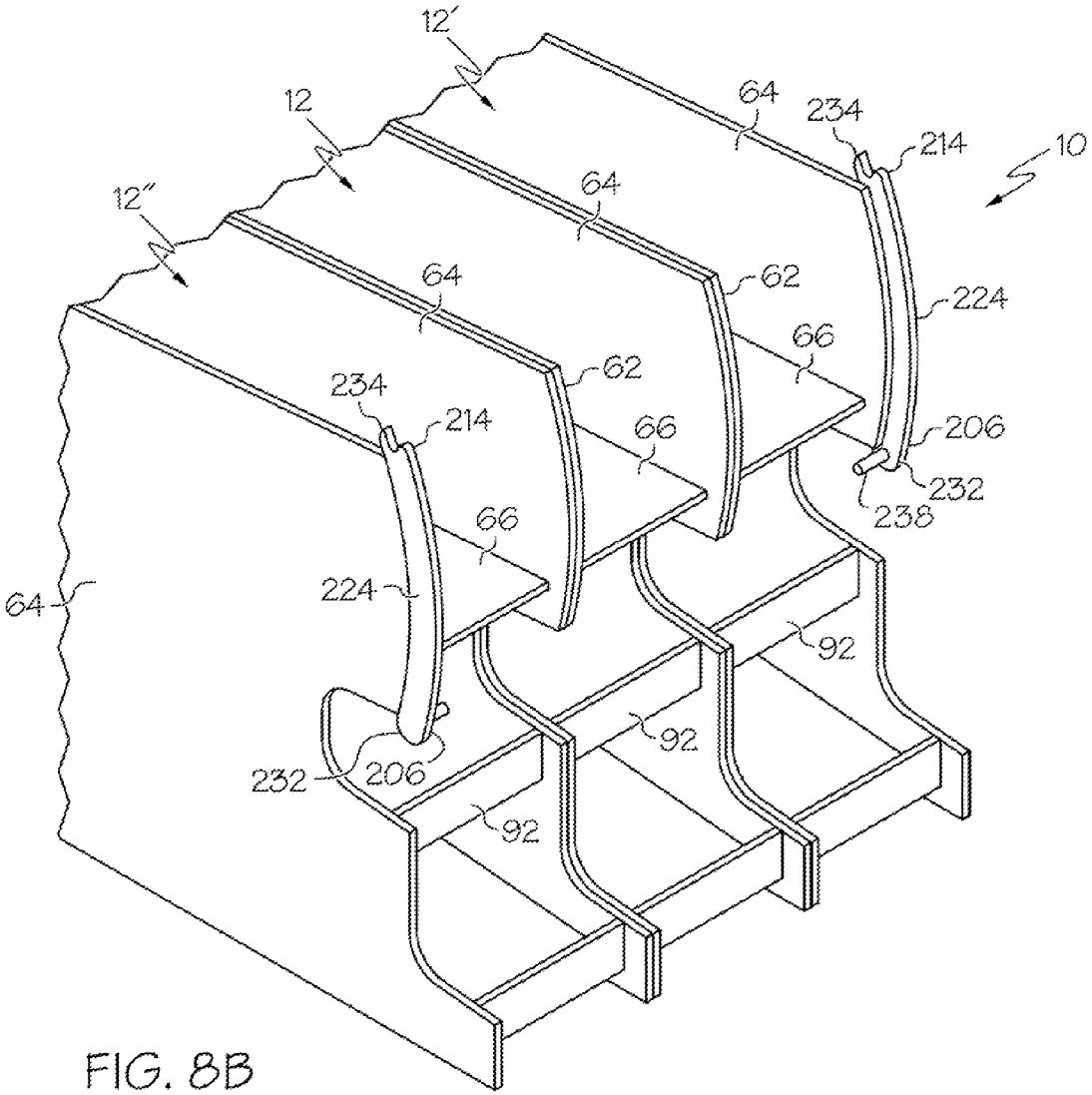
FIG. 8B is a partial front perspective view of the product dispensing system of FIG. 8A with the dispenser door removed.
Figure 9:
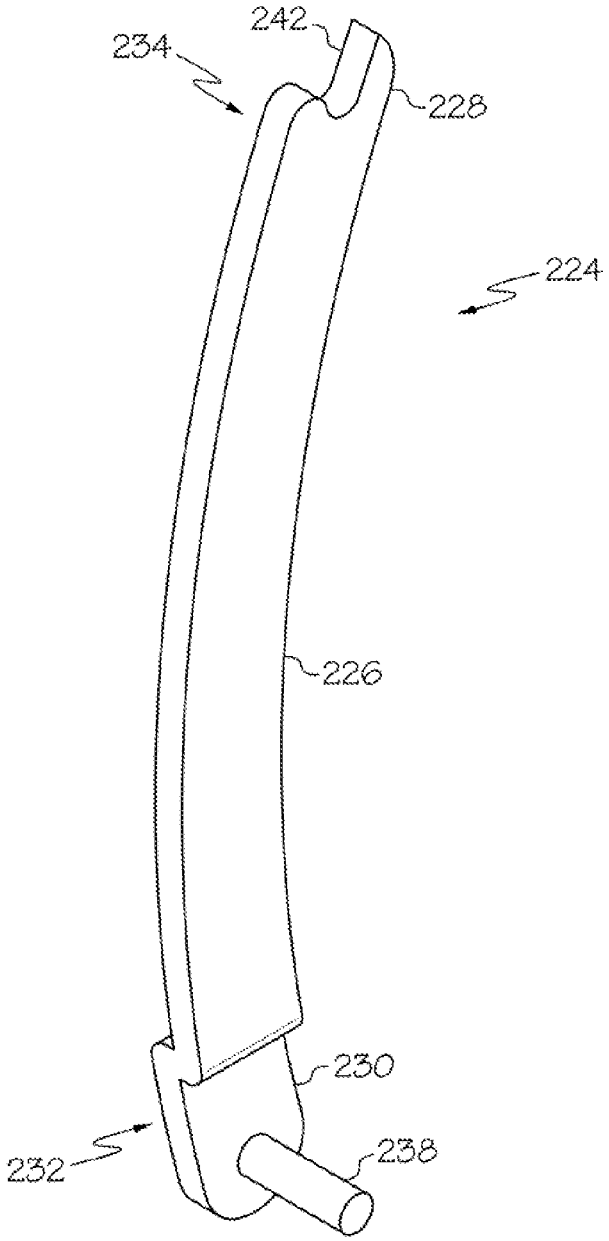
FIG. 9 is a side perspective view of a bracket of the product dispensing system of FIG. 8A.

Referring to FIGS. 8A, 8B and 9, in another aspect of the disclosed product dispensing system 10, the dispenser door 200 may be connected to the plurality of dispensers 12 by a pair of brackets 224. A first bracket 224 is connected to the front upper end of the right side wall 62 of the right outermost dispenser 12' and a second bracket 224 is connected to the front upper end of the left side wall 64 of the left outermost dispenser 12". The brackets 224 may be connected to inner or outer surfaces of the side walls 62, 64 proximate the front end 74 of the frame 60. Each bracket 224 may include a bracket body 226 having an upper end 228 positioned about the upper edge of the side walls 62, 64 and a lower end 230 positioned proximate the upper support deck 66. The lower end 230 of the bracket 224 may include a bracket hinge feature 232 for connection with the door hinge features 210. The upper end 228 of the bracket 224 may include a bracket retaining feature 234 for operative connection with the door retaining features 218 to secure the door 200 in the closed position.

In one implementation of the disclosed product dispensing system 10, the door hinge feature 210 may be a pair of apertures formed through opposing outside edges of the lower end 208 of the door panel 202. The bracket hinge features 232 may be horizontally aligned cylindrical protrusions 238 extending outwardly from the lower end 230 of the bracket body 226. The apertures may receivably engage the protrusions 238 to pivotably connect the door 200 to the dispensers 12', 12". The door retaining feature 218 may be a pair of protrusions 240 extending outwardly from opposing sides of the upper end 216 of the door panel 202. The bracket retaining feature 234 may be a generally J-shaped notch 242 disposed along a top edge of the upper end 228 of the bracket 224. The notches 242 of the brackets 224 may receivably retain the protrusions 240 of the door 200 to releasably retain the door 200 in the closed position.

Figure 10:
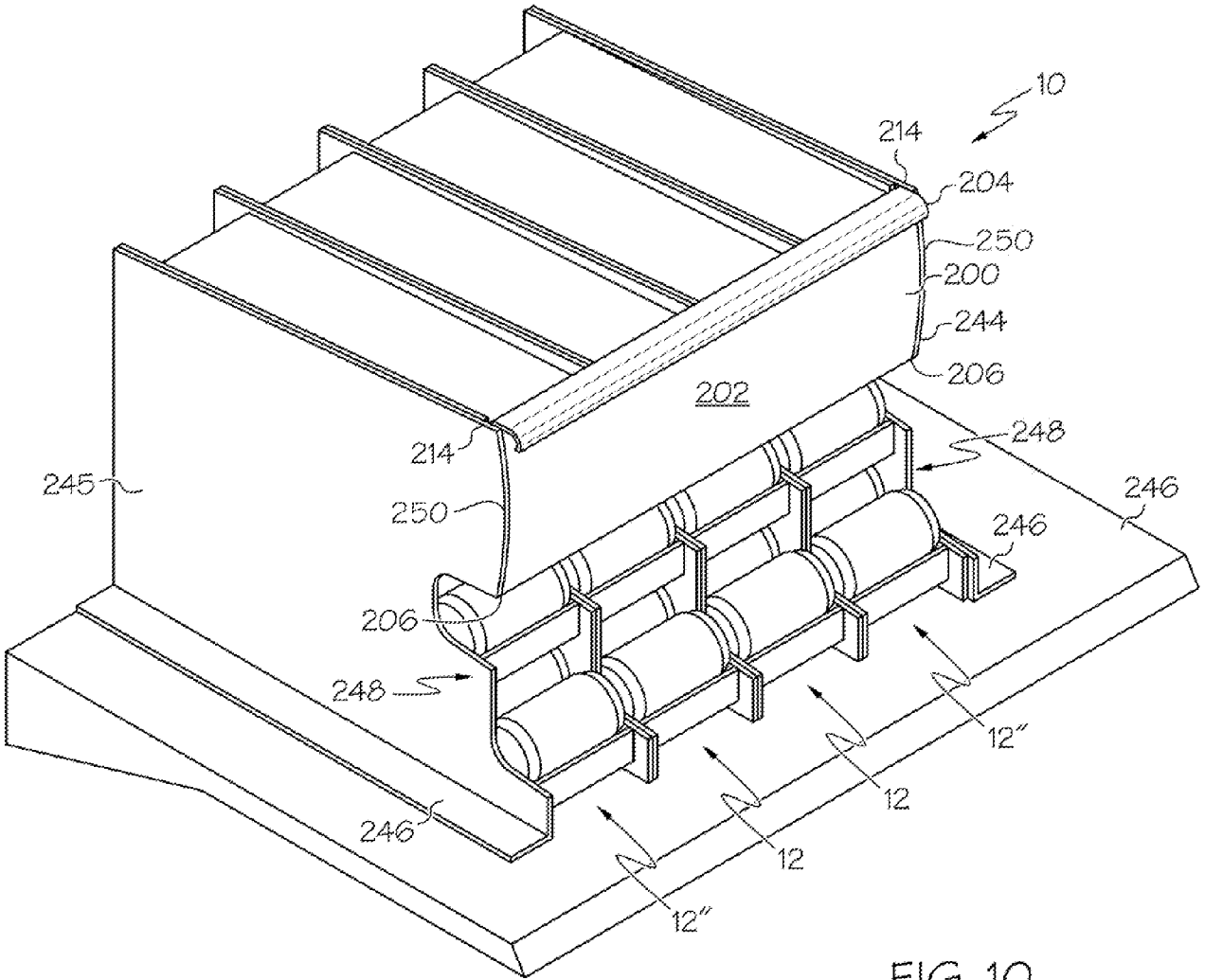
FIG. 10 is a front perspective view of another aspect of the disclosed product dispensing system; and, FIG. 11 is a partial exploded view of the product dispensing system of FIG. 10.
Figure 11:
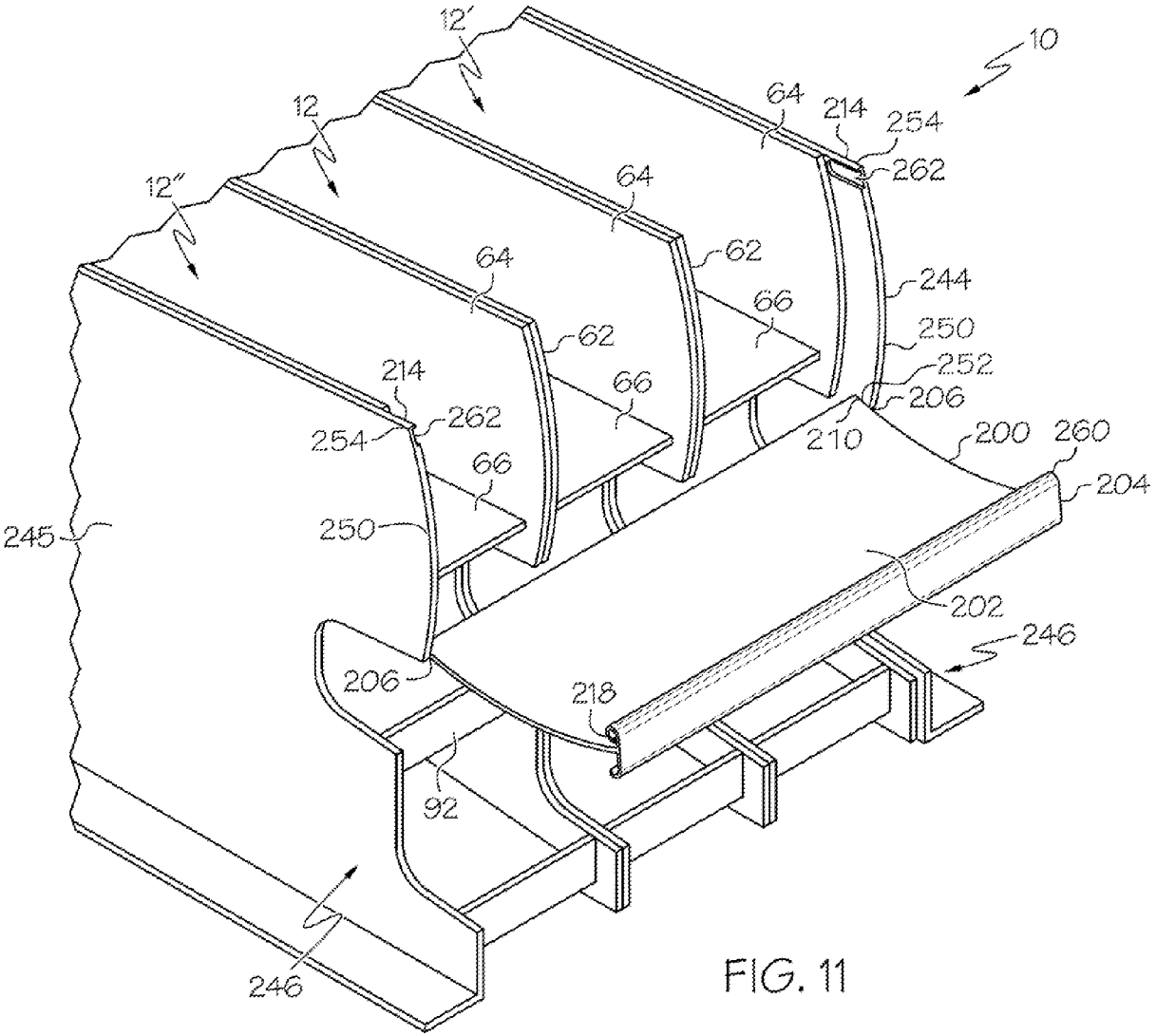

Referring to FIGS. 10 and 11, in another aspect of the disclosed product dispensing system 10, the dispenser door 200 may be connected to the plurality of dispensers 12 by a pair of end panels 244, 245. A right end panel 244 is connected to the outside of the right side wall 62 of the right outermost dispenser 12' and a left end panel 245 is connected to the outside of the left side wall 64 of the left outermost dispenser 12". Optionally, each end panel 244, 245 may include a perpendicular flange 246 along a lower edge for connection to the display support surface 17. The end panels 244, 245 may have a front end 248 having a profile shape that matches the profile of the front end of the side walls 62, 64 to provide access to the first and second product display areas 84, 94. The end panels 244, 245 may be connected to outer surfaces of the side walls 62, 64.

In such an embodiment, a front upper end 250 of the end panels 244, 245 may extend past the front end 74 of the frame 60, such that the side walls 62, 64 of the plurality of dispensers 12 do not interfere with the door 200 when in the closed position. The front upper end 250 of each end panel 244, 245 may include a panel hinge feature 252 for connection with the door hinge features 210 and a panel retaining feature 254 for operative connection with the door retaining features 218 to secure the door 200 in the closed position.

In another implementation of the disclosed product dispensing system 10, the door hinge feature 210 may be a pair of apertures formed through opposing outside edges of the lower end 208 of the door panel 202. The panel hinge features 252 may be horizontally aligned protrusions extending outwardly from the interior surfaces of the right and left end panels 244, 245. The apertures may receivably engage the protrusions to pivotably connect the door 200 to the end panels 244. The door retaining feature 218 may be a coiled spring 260 and the panel retaining features 254 may be a pair of horizontally aligned grooves 262 disposed partially through oppositely facing interior surfaces of the right end panel 244 and left end panel 245 (the groove 262 of the left end panel is hidden in the drawing view and is thus shown with broken lines). The spring 260 may include at least one elongated coil of resilient spring material protruding outwardly from and extending along a rear side of the upper end 216 of the door panel 202. Alternatively, a pair of shortened coiled springs 260 may extend outwardly from opposing ends of the rear side of the upper end of the door panel 202 (not shown). The grooves 262 may have a width slightly smaller than a diameter of the coil of the spring 260 in an uncompressed condition. Upon insertion of the spring 260 within the grooves 262, the spring 260 is slightly compressed such that the outer surface of the spring 260 is in contact with the upper and lower surfaces of the groove 262 to releasably retain the door 200 in the closed position.

At this point, those skilled in the art will appreciate that various hinge features 206 and retaining features 214 of the door 200, the side walls 62, 64, the brackets 224, and the end panels 244, 245 may be implemented in various combinations such as those described in U.S. Ser. No. 13/595,316 (discussed above) and as such, the examples shown are not meant to limit the scope of the present disclosure. It can also be appreciated by one skilled in the art that various alternative structural features may be utilized to form the pivotal connection of the hinge feature 206 and the operative connection of the retaining feature 214 other than those described herein, and as such, the aspects described herein are not meant to limit the scope of the present disclosure.

Accordingly, the disclosed product dispensing systems may employ multiple support decks with multiple product display areas, thereby increasing the amount of product being displayed to potential consumers and increasing the amount of product that may be supported by a given dispenser. Furthermore, the disclosed product dispensing systems may improve stocking efficiency by optionally employing an opening tool configured to automatically open a container as the container is loaded onto the dispenser. Furthermore, the disclosed product dispensing system may enclose and discreetly cover the loaded container and upper support deck with a downwardly opening door having a handle the allows the door to be opened given very little space between the top of the product dispensing system and the bottom of an overhead dispenser support surface.

Although various aspects of the disclosed product dispensing system with upper support deck door have been shown and described, modifications may occur to those skilled in the art upon reading the specification. The present application includes such modifications and is limited only by the scope of the claims.

What is claimed is:

1. A product dispensing system comprising:

a plurality of discrete dispenser frames, said plurality of discrete dispenser frames being arranged in a side-by-side configuration comprising a first exterior dispenser frame, a second exterior dispenser frame, and at least one interior dispenser frame positioned between said first and second exterior dispenser frames, each dispenser frame of said plurality of discrete dispenser frames comprising:

a front end and a longitudinally opposed rear end;

a first side wall and a laterally opposed second side wall extending between said front end and said rear end;

an upper support deck extending at least partially between said front end and said rear end; and a lower support deck positioned below said upper support deck, said lower support deck extending between said front end and said rear end and defining a product display area;

a first bracket connected to said first side wall of said first exterior dispenser frame, said first bracket extending beyond said front end of said first exterior dispenser frame;

a second bracket connected to said second side wall of said second exterior dispenser frame, said second bracket extending beyond said front end of said second exterior dispenser frame; and a door extending between said first bracket and said second bracket proximate said upper support decks of said plurality of discrete dispenser frames.

2. The product dispensing system of claim 1 wherein said product display area is proximate said front end of the respective one of said plurality of discrete dispenser frames.

3. The product dispensing system of claim 1 wherein said first bracket and said second bracket each comprises a lower end; and wherein said door comprises a lower end pivotably connected to said lower end of said first and second brackets by a hinge feature proximate said upper support deck of said first and second exterior dispenser frames.

4. The product dispensing system of claim 1 wherein said first bracket and said second bracket each comprises an upper end; and wherein said door comprises an upper end releasably connected to said upper end of said first and second brackets by a retaining feature.

5. The product dispensing system of claim 1 wherein said door comprises an upper end and a handle extending outwardly from said upper end; and wherein said handle comprises a downwardly projecting lip spaced away from said door.

6. The product dispensing system of claim 1 wherein:

said first bracket and said second bracket each comprises an upper end and a lower end; and said door comprises:

an upper end, a lower end, a front, and a rear;

a hinge feature positioned about said lower end of said door and pivotably connected to said lower end of said first and second brackets proximate said upper support deck of said first and second exterior dispenser frames; and, a handle connected to said upper end of said door, said handle comprising a downwardly projecting lip extending outwardly from said front of said door and a retaining feature extending outwardly from said rear of said door, said retaining feature being releasably connected to said upper end of said first and second brackets;

wherein said door is openable in response to a force applied to said handle to access said upper support decks of said plurality of discrete dispenser frames.

7. The product dispensing system of claim 6 wherein said handle is removable from said upper end of said door.

8. The product dispensing system of claim 1 further comprising:

a plurality of containers on said upper support decks of said plurality of discrete dispenser frames behind said door; and, a plurality of products initially housed in said containers;

wherein at least one product of said plurality of products is positioned in each one of said product display areas.

9. A product dispensing system comprising:

a plurality of discrete frames, said plurality of discrete frames being arranged in a side-by-side configuration comprising a first exterior frame, a second exterior frame, and at least one interior frame positioned between said first and second exterior frames, each frame of said plurality of discrete frames comprising:

a front end and a longitudinally opposed rear end;

a first side wall and a laterally opposed second side wall extending between said front end and said rear end;

an upper support deck extending at least partially between said front end and said rear end, said upper support deck being configured to support one container of said plurality of containers; and a lower support deck positioned below a upper support deck, said lower support deck defining a product display area;

a first end panel positioned adjacent to said first side wall of said first exterior frame, at least a portion of a front end of said first end panel extending beyond said front end of said first exterior dispenser;

a second end panel positioned adjacent to said second side wall of said second exterior frame, at least a portion of a front end of said second end panel extending beyond said front end of said second exterior dispenser;

a door extending between said first first end panel and said second end panel proximate said front ends to access said upper support decks of said plurality of discrete frames simultaneously.

10. The product dispensing system of claim 9 wherein said door comprises a lower end hingedly connected to said first end panel and said second end panel proximate said upper support decks.

11. The product dispensing system of claim 9 wherein said door comprises an upper end releasably connected to said first end panel and said second end panel.

12. The product dispensing system of claim 9 wherein said door comprises:

an upper end, a lower end, a front and a rear, said lower end being pivotably connected to said first end panel and said second end panel by a hinge feature proximate said upper support decks of said first exterior frame and said second exterior frame; and a handle disposed on said upper end of said door, said handle comprising a downwardly projecting lip extending outwardly from said front of said door and a retaining feature extending outwardly from said rear of said door, said retaining feature being releasably connected to first end panel and said second end panel;

wherein said door is openable in response to a force applied to said handle to access said upper support decks of said plurality of discrete frames.

13. The product dispensing system of claim 11 wherein said door comprises:

a retaining feature protruding from said upper end, said retaining feature being releasably connected to said first and second end panels; and a handle extending outwardly from said upper end; and wherein said handle comprises a downwardly projecting lip spaced away from said door.

14. The product dispensing system of claim 9 wherein said door comprises a handle connected to an upper end of said door, said handle comprising a downwardly projecting lip extending outwardly from a front of said door.

15. The product dispensing system of claim 9 wherein said first and second end panels each comprises a perpendicular flange configured to attach to a dispenser support surface.

16. A method for dispensing a plurality of product initially provided in a container, said method comprising the steps of:

providing a plurality of discrete dispensers, each dispenser of said plurality of discrete dispensers comprising:

a frame having a front end and a rear end, a first side wall and a laterally opposed second side wall extending between said front end and said rear end, an upper support deck extending at least partially between said front end and said rear end, and a lower support deck positioned below said upper support deck, said lower support deck defining a product display area;

arranging said plurality of discrete dispensers in a side-by-side configuration comprising a first exterior dispenser, a second exterior dispenser, and at least one interior dispenser positioned between said first and second exterior dispensers;

connecting a first bracket to said first side wall of said first exterior dispenser, said first bracket extending beyond said front end of said first exterior dispenser;

connecting a second bracket to said second wall of said second exterior dispenser, said second bracket extending beyond said front end of said second exterior dispenser;

pivotably connecting a door between said first and second brackets proximate said upper support decks of said first and second exterior dispensers such that said door provides access to said upper support decks of said plurality of dispensers simultaneously; and positioning a plurality of containers on said upper support decks behind said door.

17. The product dispensing system of claim 9 wherein each frame of said plurality of discrete frames comprises an opening tool arranged to open a container when said container is moved longitudinally along said upper support deck to allow a plurality of products to be at least partially dispensed from said container to said product display area.

* * * * *